United States Patent [19]

Stepanenko et al.

[11] Patent Number: 5,064,521

[45] Date of Patent: Nov. 12, 1991

[54] APPARATUS FOR ELECTROCHEMICAL MACHINING

[75] Inventors: Alexandr V. Stepanenko; Vladimir K. Stanishevsky; Alexandr E. Parshuto; Alexandr A. Kosobutsky; Vsevolod A. Khlebtsevich, all of Minsk; Sergei S. Malyavko, Mogilev; Leonid M. Semenenko, Minsk; Sergei V. Loginov, Minsk; Grigory E. Slepnev, Minsk, all of U.S.S.R.

[73] Assignee: Belorussky Politekhnichesky Institut, Minsk, U.S.S.R.

[21] Appl. No.: 543,799

[22] PCT Filed: Oct. 25, 1988

[86] PCT No.: PCT/SU88/00208

§ 371 Date: Jul. 24, 1990

§ 102(e) Date: Jul. 24, 1990

[87] PCT Pub. No.: WO90/04665

PCT Pub. Date: Mar. 3, 1990

[51] Int. Cl.[5] ..... B23H 3/10

[52] U.S. Cl. ..... 204/224 M; 204/225; 204/232; 204/275; 204/297 R; 204/273; 204/228

[58] Field of Search ..... 204/224 M, 225, 228, 204/237–238, 275, 273, 297 R, 232

[56] References Cited

U.S. PATENT DOCUMENTS

| | | | |
|---|---|---|---|
| 2,737,488 | 3/1956 | Gray | 204/206 |
| 3,239,438 | 3/1966 | Voorhees | 204/238 X |
| 3,554,892 | 1/1971 | Schellens et al. | 204/225 X |
| 3,720,595 | 3/1973 | Kohler | 204/225 X |
| 4,326,933 | 4/1982 | Sabatka et al. | 204/206 X |
| 4,842,702 | 6/1989 | Kuwabara et al. | 204/238 X |
| 4,941,955 | 7/1990 | Schuster | 204/225 X |

FOREIGN PATENT DOCUMENTS

| | | |
|---|---|---|
| 143289 | 1/1962 | U.S.S.R. . |
| 1465431 | 2/1977 | United Kingdom . |
| 1557017 | 12/1979 | United Kingdom . |

OTHER PUBLICATIONS

A. M. Yampolsky, "Travlenie metallov", 1964, The Mashinostroenie Publishers, Moscow, Leningrad, pp. 58 & 59, Fig. 19.

*Primary Examiner*—Donald R. Valentine
*Attorney, Agent, or Firm*—Lilling & Lilling

[57] ABSTRACT

An apparatus for electrochemical machining has a bath for machining workpieces capable of providing in the zone of treatment an ascending laminar flow of electrolyte occupying the bath. A bath for cleaning the electrolyte communicates with the bath for machining the workpieces by way of a pipe for feeding the electrolyte having a pump and pipe for discharging the electrolyte. The workpieces are conveyed to the bath by workpiece gripping mechanisms.

10 Claims, 6 Drawing Sheets

APPARATUS FOR ELECTROCHEMICAL MACHINING

BACKGROUND OF THE INVENTION

1. Field of the Invention

This invention relates to electrochemical and electrophysical machining, and more particularly to an apparatus for electrochemical machining of workpieces.

The proposed invention can be used with success for machining elongated workpieces of different cross sectional shape (such as rods, wires, saw blades, shaped rolled products), as well as for polishing the surfaces of workpieces of intricate spatial configuration (such as tableware, electric razors, dentures).

2. Description of the Related Invention

There is known a plasma gun for continuously treating a rolled product designed in the USSR and comprising a bath for heating the workpiece under a layer of electrolyte, side walls of the bath having ports with seals to prevent leaks of the electrolyte, a mechanical current supply contact, a pipe for feeding electrolyte to the bath to be heated, and a pipe for discharging the electrolyte. The housing of the bath functions as the anode, whereas the workpiece functions as the cathode.

However, construction of this known plasma gun fails to ensure a laminar flow of electrolyte in the zone of machining the workpiece. Lack of the laminar character of the flow of electrolyte causes separation of a vaporgas blanket from the workpiece to result in insufficiently high quality of the machined surface. The use in this apparatus of a mechanical current supply contact results at high voltages of, for example, 250–300 V in burns at the surface of the moving workpiece. In addition, this known apparatus fails to ensure selective treatment of the workpiece surface due to a failure to vary the intensity of treatment at different surface portions of elongated workpieces.

Another disadvantage of the above prior art apparatus is failure to provide uniform treatment of the workpiece due to lack of rotation of the workpiece about its longitudinal axis as it moves through the bath for heating.

There is also known an apparatus for electropolishing stainless steel workpieces (cf., GB, A, 1,557,017) comprising a bath accommodating electrodes, means for conveying workpieces to the bath with workpiece grips and a bath for cleaning the electrolyte. The means for conveying the workpiece to the bath includes a conveyer which grips and carries cartridge-enclosed workpieces after stamping and shaping operations. The cartridges have arcuate step elements and plate contacts with the workpieces clamped between these contacts. The cartridges are moved by the conveyer to be successively immersed in the bath. As the cartridges move lengthwise of the bath, the workpieces are electropolished in a solution of orthophosphoric and sulphuric acids. The bath is made of an acid —resistant material, such as polyethylene. Provided at two sides of the moving cartridges are cathode plates imparting to the electrolyte a negative potential. In the course of movement in the bath the cartridges are brought in contact with anode rods imparting to the workpiece a positive potential. After polishing, the workpieces are removed from the bath to be conveyed to a successive bath to be passivated in a solution of nitric acid. Subsequent to passivation, the cartridges with workpieces are conveyed to a washing device where the workpieces are washed in cold and hot water. Then the workpieces are removed from the cartridges, and new workpieces to be treated are loaded into the cartridges.

In this known apparatus the bath fails to provide an ascending laminar flow due to the lack of means for pumping the electrolyte through the treatment zone, which results in low quality of workpiece processing.

The cathode plates are fixed, and therefore during the treatment of workpieces of intricate spatial configuration the density of current in the electrolyte at different surface portions of the workpiece is distributed non-uniformly.

In addition, immersion in the electrolyte of arcuate stops and plate contacts accelerates their premature dissolution and disintegration.

The horizontal positioning of workpieces in the bulky cartridges promotes shielding of the workpieces by the structural elements of the cartridge and prevents uniform treatment of the workpieces by an ascending flow of electrolyte. Further, each workpiece is held inside the cartridge at four points to cause additional shielding effect and larger non-treated surface areas.

The ivariable horizontal position of workpieces of intricate spatial configuration during treatment results in non-uniform processing of different surface portions of the workpieces.

SUMMARY OF THE INVENTION

The present invention aims at providing an apparatus for electrochemical machining in which a bath for machining workpieces and means for conveying the workpieces to the bath would be so constructed as to ensure relative movement of electrolyte and workpieces and thereby improve the quality of machining.

The aims of the invention are attained by an apparatus for electrochemical machining a ton machining workpieces bath, electrodes accommodated in the bath, means for conveying the workpieces to be machined to the bath with mechanisms for gripping the workpieces, and a bath for cleaning the electrolyte communicating with the bath for machining the workpieces by way of a pipe for feeding the electrolyte having a pump, and a pipe for discharging the electrolyte wherein, according to the invention, the bath for machining workpieces is capable of providing, in the zone of machining, an ascending laminar flow of electrolyte occupying the bath.

Preferably, the bath for machining the workpieces has a partition arranged in parallel with a bottom to define therebetween a damping chamber communicating with the pipe for feeding the electrolyte and provided with a group of wire-gauze ejectors equal in number to the number of workpieces being machined and a means for maintaining inside the bath, a preset level of electrolyte in the form of an overflow pipe extending through the bottom of the bath and partition, and communicating with the pipe for discharging the electrolyte.

Preferably, the bath for machining the workpieces has a group of shields equal in number to at least the number of workpieces being machined, each of the shields tightly fitting to at least one surface of each workpiece being machined.

Desirably, each shield has shaped through ports.

Importantly, the walls of the bath for machining the workpieces have holes arranged in pairs one in front of the other and having a shape corresponding to the shape of the workpieces being machined, each such hole communicating with a respective discharge passage in turn communicating with the bath for cleaning the electrolyte.

Favorably, the apparatus is provided with a means for applying to the workpiece a voltage polarity opposite to the polarity of the voltage applied to the electrolyte.

Preferably, the means for applying to the workpiece a voltage polarity opposite to the polarity of the voltage applied to the electrolyte has the form of two chambers oppositely arranged relative to the bath for machining the workpieces and communicating by way of pipes with a means for pumping the electrolyte provided inside a vessel walls. The chambers have, holes for the passage of the workpieces being machined, arranged coaxially with the holes made in the walls of the bath for machining the workpieces, each chamber having a means for maintaining therein a preset level of the electrolyte in the form of an overflow pipe communicating by way of a pipe with the vessel.

In a different embodiment of the invention the bath for machining the workpieces should preferably have two vertical partitions of which one such pertition is positioned with a clearance relative to the bottom of the bath, and a horizontal partition arranged with a clearance relative to the bottom of the bath and connected to the inner side walls of the vertical partitions to define a damping chamber and provided with a group of wire-gauze ejectors equal in number to the number of means for feeding the workpieces to the bath and extending through the length of the partition in the area where the workpieces rest, the electrodes being capable of varying the angle of inclination relative to their vertical axes.

Advisably, for ensuring that the ascending laminar flow of electrolyte could flow around all the portions of the workpiece surface, each mechanism for gripping the workpieces has the form of a rake with a number of teeth corresponding to the number of workpieces being machined, each tooth having a three-point grip having an electrical contact engageable with the surface of the workpiece being machined.

Preferably, the surface of each electrical contact of the three-point grip engageable with the surface of the workpiece has the form of a prism.

Advantageously, each means for conveying the workpiece to the bath has a pivot unit.

The proposed invention makes it possible to materialize the capabilities of the electrochemical machining method, such as to provide conditions for polishing, cleaning, and a combination of polishing and cleaning operations. In addition, the apparatus according to the invention allows machining workpieces of intricate spatial configuration, elongated workpieces, workpieces of finite dimensions with locations inaccessible for the conventional electrochemical machining methods ensuring reduction in the surface roughness by a factor of 2–3 and attaining a bright metallic surface luster. The invention is also advantageous in obviating unproductive manual operations through mechanizing and automating the machining process.

BRIEF DESCRIPTION OF THE DRAWINGS

The invention will now be described in greater detail with reference to various preferred embodiments thereof taken in conjunction with the accompanying drawings, in which.

DESCRIPTION OF THE PREFERRED EMBODIMENT

Figure 1:
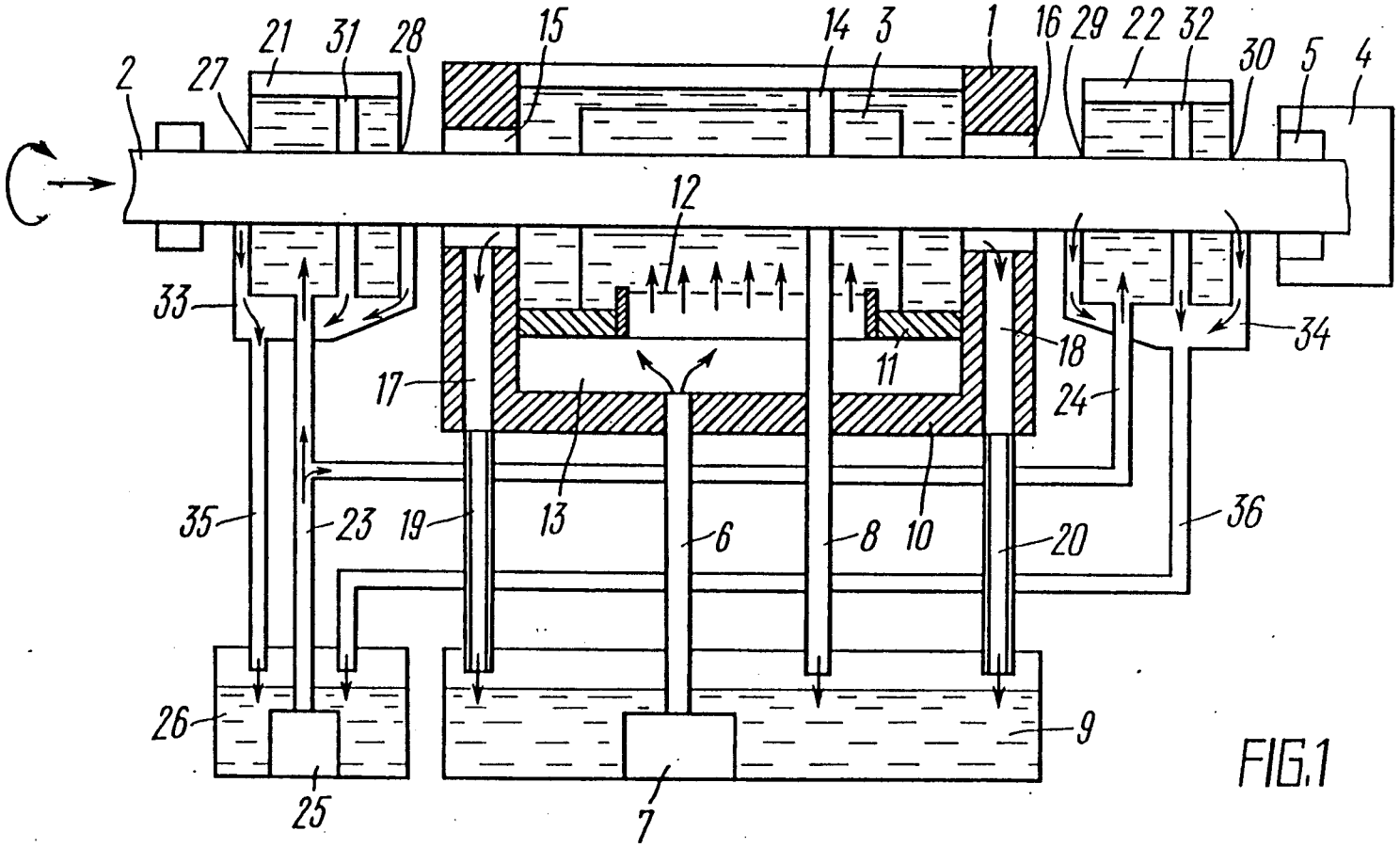
FIG. 1 is a general view of the proposed apparatus for electrochemical machining with one embodiment of a bath for machining workpieces.
Figure 2:
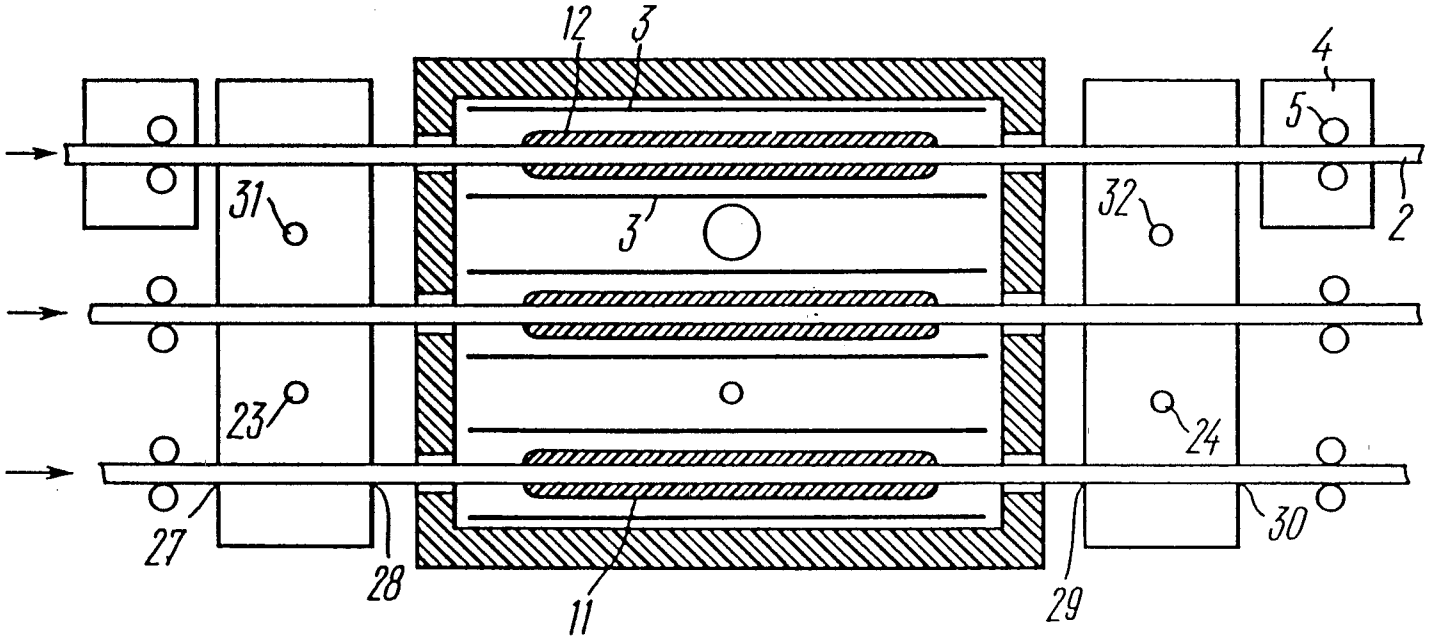
FIG. 2 is a top view of the apparatus shown in FIG. 1.

An apparatus for electrochemical machining according to the invention comprises a bath 1 (FIG. 1) for processing workpieces 2 made of a dielectric material, electrodes 3 accommodated inside the bath 1, means 4 (FIGS. 1,2) for conveying the workpieces 2 to the bath 1 having mechanisms 5 for gripping the workpieces 2. The bath 1 communicates, by way of a pipe 6 for feeding electrolyte having a pump 7 and a pipe 8 for discharging electrolyte, with a bath 9 for cleaning the electrolyte. Secured in the bath 1 in parallel to its bottom 10 is a partition 11 having wire-gauze ejectors 12 equal in number to the number of workpieces 2 being machined. Formed between the bottom 10 of the bath 1 and partition 11 is a damping chamber 13 communicating with the pipe 6. The bath 1 is provided with a means for maintaining a preset level of electrolyte in the form of an overflow pipe 14 extending through the bottom 10 of the chamber 1 and partition 11 and communicating with the pipe 8.

To allow the passage through the bath 1 of elongated workpieces 2, the bath walls are provided with holes 15, 16 arranged in pairs one in front of the other and having a shape corresponding to the configuration of the workpiece 2 being machined. The holes 15, 16 communicate with discharge conduits 17, 18, respectively, connected through pipes 19 and 20 to the bath 9 for cleaning the electrolyte.

The apparatus is further provided with a means for applying to the workpiece 2 a voltage of polarity opposite to the polarity of the voltage applied to the electrolyte occupying the bath 1. This means is fashioned as two chambers 21 and 22 arranged in opposition to the bath 1, and communicating by way of pipes 23 and 24, respectively, with a means 25 for pumping the electrolyte secured inside a vessel 26. The walls of each chamber 21, 22 have holes 27, 28 and 29, 30 for the passage of the workpieces 2. The holes 27, 28 and 29, 30 are coaxial with the holes 15, 16 provided in the walls of the bath 1. Each chamber 21 and 22 has a means for maintaining therein a preset level of electrolyte in the form of an overflow pipe 31 and 32, respectively, communicating with a tray 33 and 34, each of these transcommunicating by way of pipe 35 and 36, respectively, with the vessel 26.

Figure 3:
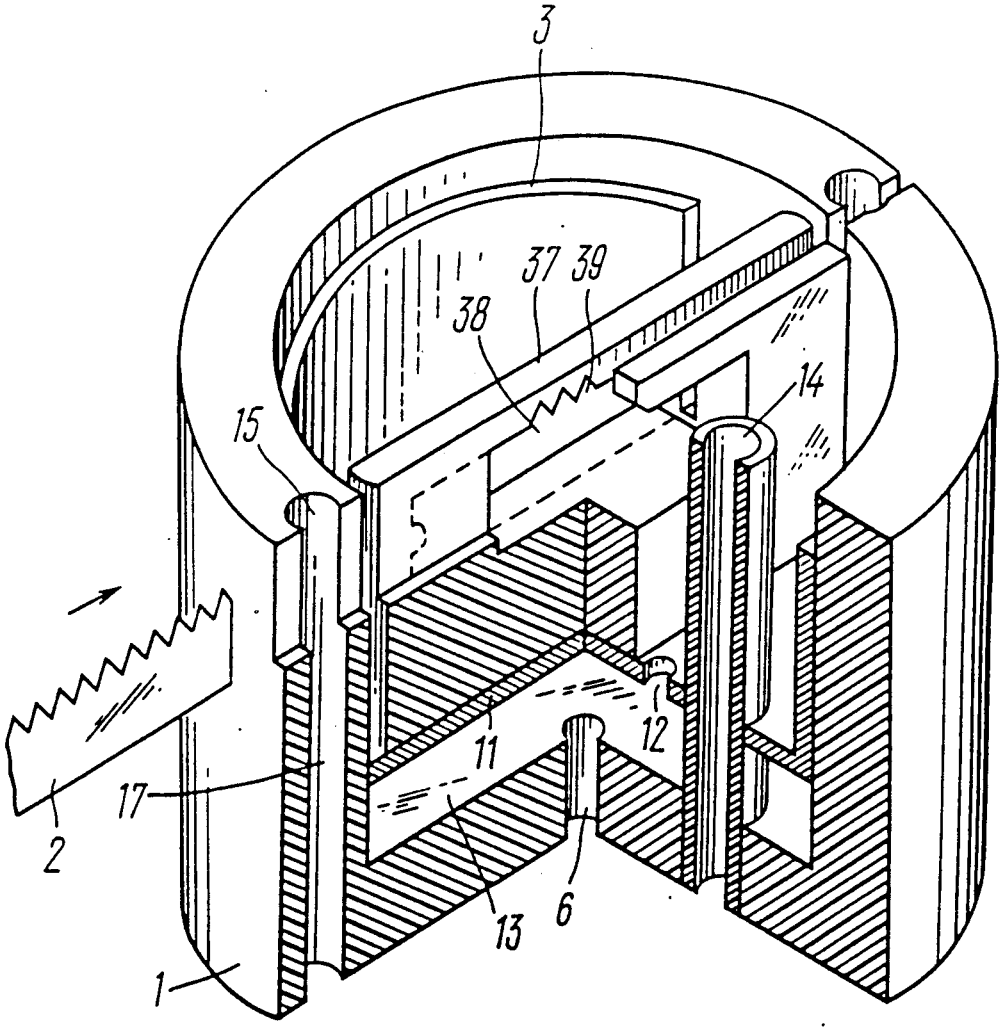
FIG. 3 is a general view of an apparatus for selective machining elongated metal workpieces according to the invention.

For selectively machining elongated workpieces 2 of cross-section other than round the bath 1 (FIG. 3) has at least one shield 37 fabricated from a dielectric material and fitting tightly to the surface of the workpiece 2 being shielded. The shield 37 has ports 38 with shaped, such as triangular, slots 39 whose vertices are directed upwards and arranged at one level with the plane of spillway of the overflow pipe 14.

Figure 4:
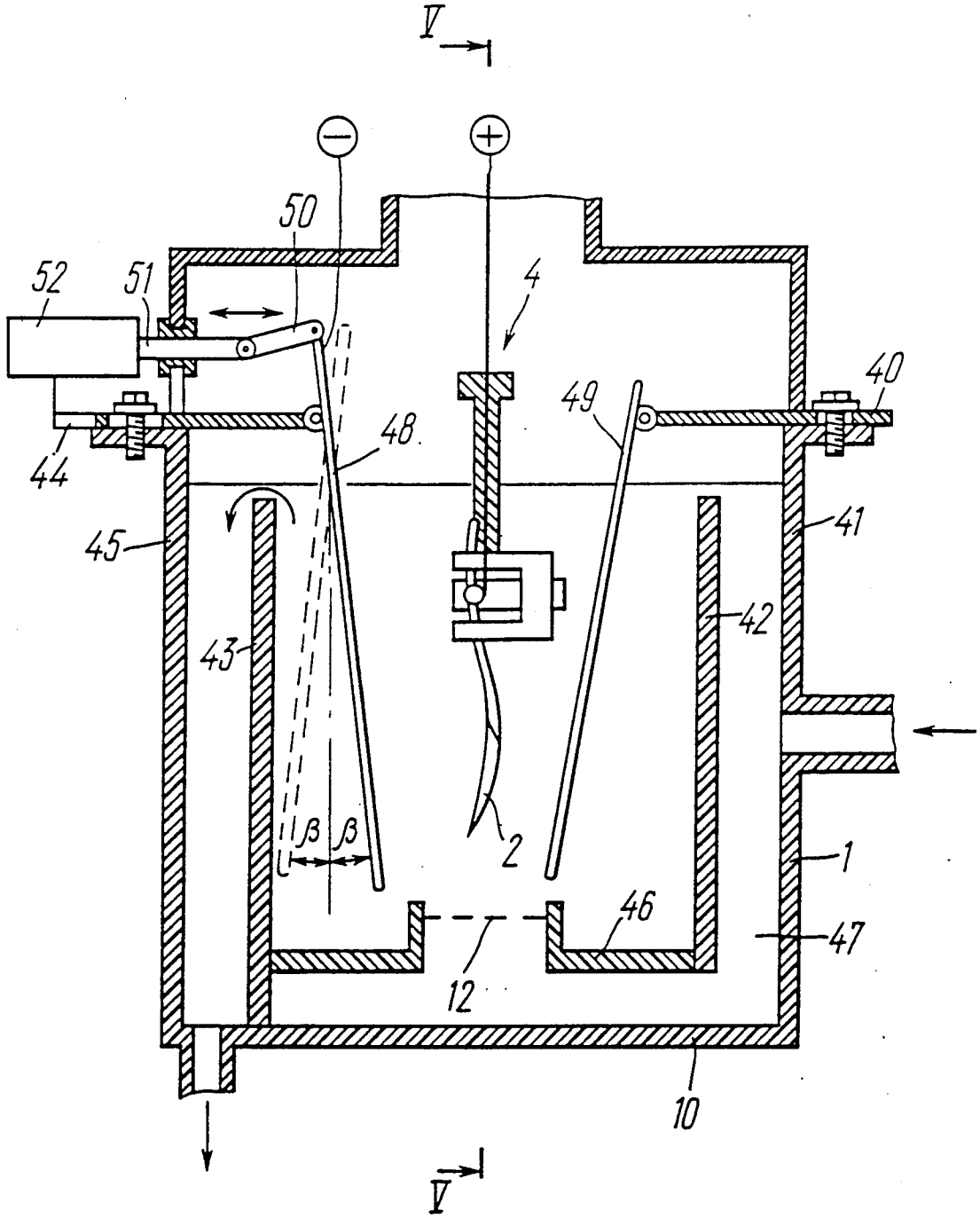
FIG. 4 is a general view of an apparatus for separate machining of workpieces according to the invention.

For separate machining of workpieces 2 (FIG. 4) use is made of a box-shaped bath 1 fabricated from a dielectric acid-resistant material. A vertical partition 42 is provided inside the bath 1 to be positioned with a clearance relative to a cover plate 40, bottom 10 and side wall 41. A second vertical partition 43 is spaced from a cover plate 44 and side wall 45. A horizontal partition 46 is also spaced from the bottom 10 of the bath 1 and is connected to the inner faces of the vertical partitions 42 and 43 to define a damping chamber 47. The partition 46 has a group of wire gauge ejectors 12 extending through its length in the area of the workpieces 2 being machined. The cover plates 40 and 44 are capable of displacement in the horizontal plane. Used as cathodes are plates 48, 49 connected by linkages 50 to rods 51 of drives 52 (the drive of the plate 49 not being shown).

The means 4 (FIG. 5) for conveying the workpieces 2 has a pivot unit 53 connected by a linkage 54 to a rod 55 of a penumatic cylinder 56 rigidly affixed by a bracket 57 on a rod 58. Each workpiece gripping mechanism 5 has the form of a rake 59 made of acid-resistant insulating material. The number of teeth 60 in the rake 59 corresponds to the number of workpieces 2 being machined. A current lead 61 is provided in the workpiece gripping mechanism 5.

Figure 6:
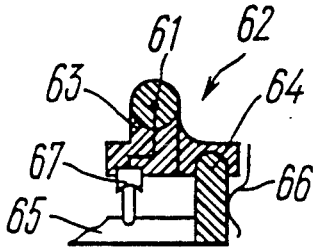
FIG. 6 shows the construction of a workpiece gripping mechanism.

Each tooth 60 has a three-point grip 62 including a casing 63 (FIG. 6) in which a pivot 64 holds a clamp 65 contacting with a spring 66, and an electrical contact 67 whose surface engageable with the surface of the workpiece 2 has the form of a prism. The electrical contact 67 is connected to the current lead 61.

Figure 7:
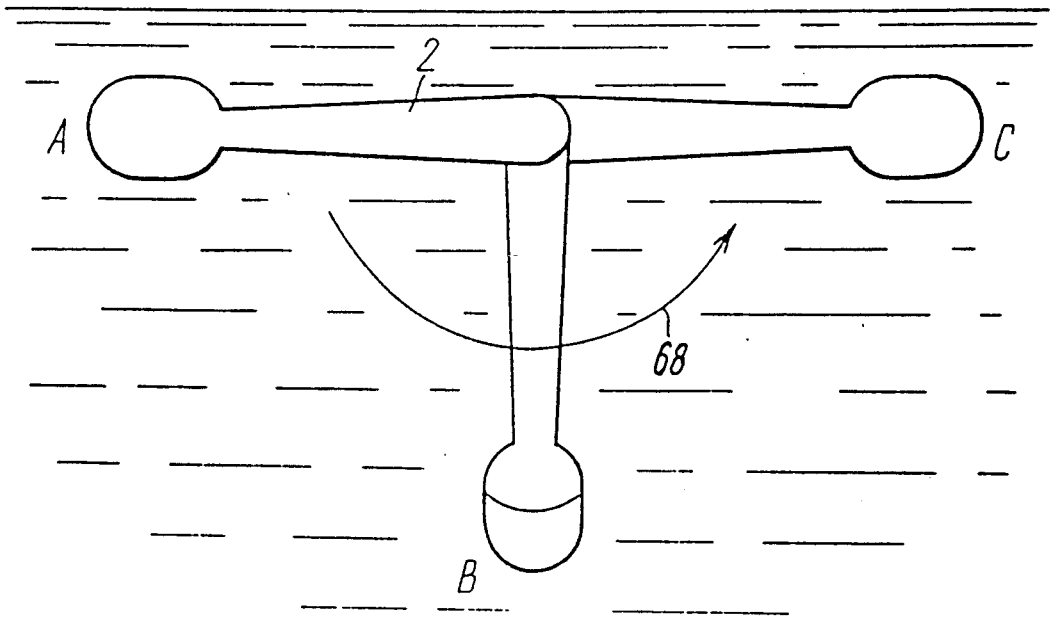
FIG. 7 illustrates diagrammatically the movement of the workpiece in the course of electrochemical machining.

FIG. 7 shows schematically the movement of the workpiece 2 during electrochemical machining, where A indicates the initial position of the workpiece 2; B, C, indicate the position of the workpiece 2 in which various portions of its surface are polished. Arrow 68 indicates direction of rotation of the workpiece 2.

Figure 8:
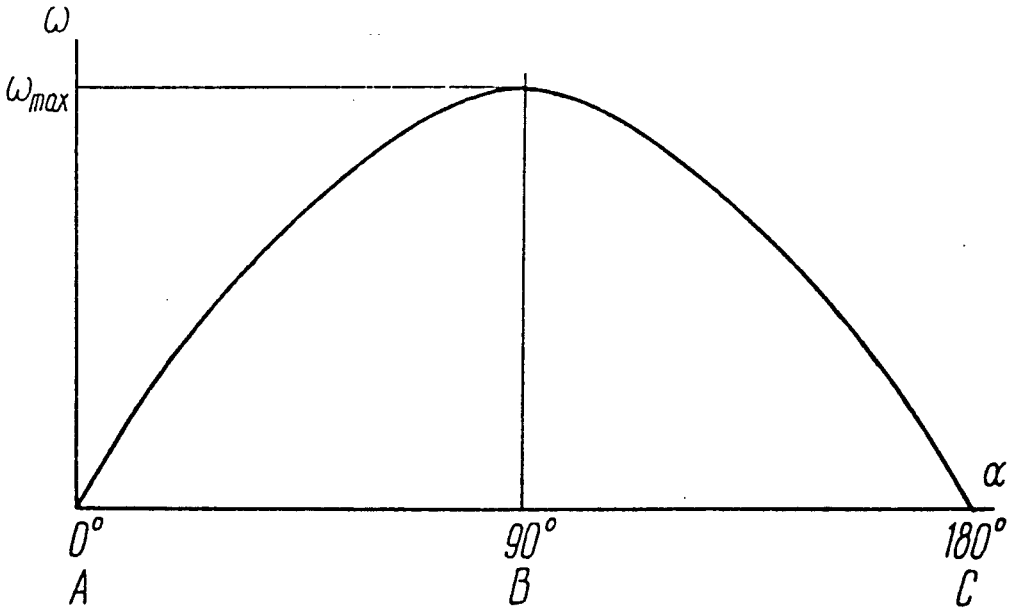
FIG. 8 represents a dependence between the angular rotational speed of the workpiece being machined and the angle of turning thereof.

FIG. 8 shows dependence of the angular rotational speed $\omega$ of the workpiece 2 (FIG. 7) on the angle $\alpha$ of rotation thereof. $\omega_{max}$ (FIG. 8) is the maximum angular speed of rotation of the workpiece 2 (FIG. 7) as it passes through the vertical position B.

The proposed apparatus operates in the following manner. The workpiece (FIG. 1) of cylindrical coaxially symmetrical shape is conveyed by the feeding means 4, while rotating about its longitudinal axis, to the chamber 21 filled with the electrolyte to which a voltage of positive polarity is applied. Electrolyte is fed through the group of ejectors 12 to the bath and a voltage of negative polarity is applied to the electrolyte by the electrodes 3. As the workpiece 2 is brought in contact with the electrolyte occupying the bath 1, a microplasma discharge is initiated at the surface of the workpiece 2 accompanied by formation of a vapor gas blanket and vigorous machining of the workpiece 2. Rotation of the workpiece 2 about its longitudinal axis facilitates uniform electrochemical machining of its surface.

Selective machining of workpieces 2 (FIG. 3) of arbitrary shape, such as a saw blade, is carried out in the following manner. The elongated workpiece 2 is conveyed by the means 4 and gripping mechanism 5 to the chamber 21 (FIG. 1) filled with the electrolyte to which a voltage of positive polarity is applied, whereby the workpiece 2 is energized by a voltage of positive polarity. Then the workpiece 2 is conveyed through the hole 15 to the interior of the bath 1 between the shields 37 (FIG. 3) to the working zone confined by the shaped ports 33 for the teeth of the saw blade to pass through the triangular grooves 39. As the saw blade starts to pass through the port 38 a vapor-gas blanket appears in the zone of contact between the saw blade and electrolyte to result in microplasma discharge. When the teeth of the saw blade pass through the triangular grooves 39, they are partially shielded from the vapor-gas blanket. Such machining of a saw blade makes it possible to preserve the cutting properties of the working edge of the saw blade tooth.

The chambers 21 and 22 (FIG. 1) are necessary for substituting a mechanical spark discharge contact by a galvanic or liquid to obviate burns of the surface of the workpiece being machined.

Provision of the overflow pipes 14, 31 and 32 allows maintenance of the electrolyte at the preset level both in the bath 1 and in the chambers 21, 22. The conduits 17, 18 ensure discharge of the electrolyte to the bath 9. Trays 33 and 34 collect the electrolyte leaking from the chambers 21 and 22 through the clearance between the workpiece 2 and holes 27 and 28 in the chambers 21 and 22 for the electrolyte to be conveyed along the pipes 35, 36 to the vessel 26.

Figure 5:
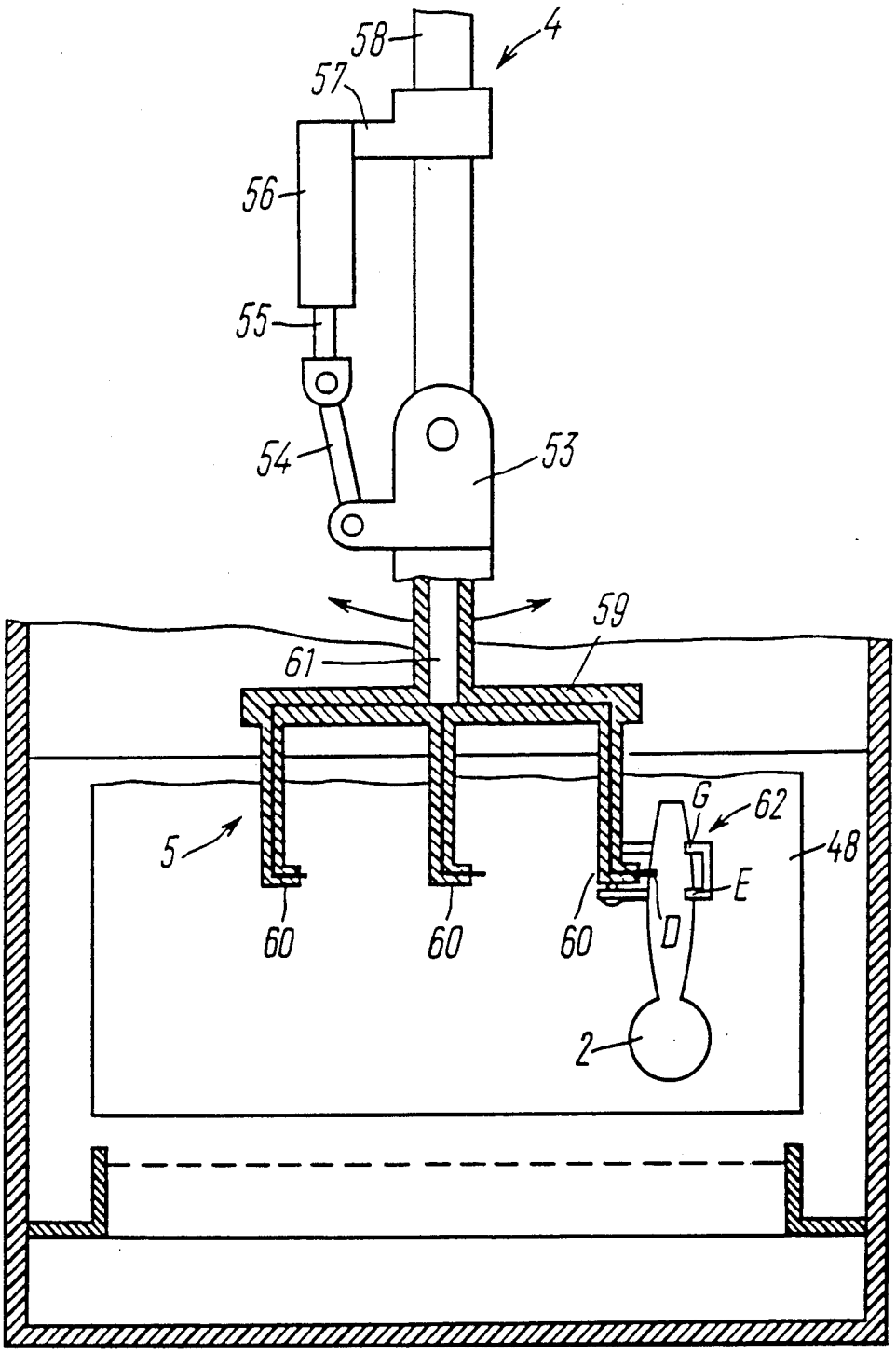
FIG. 5 is a section taken along the line V—V in FIG. 4.

Workpieces 2 (FIG. 4) of intricate shape are processed by placing them into the means 5. These workpieces 2 are clamped by the three-point grips 62 (FIG. 5). A drive (not shown) of the vertical feeding of the workpiece 2 is energized and the electrolyte present in the bath 1 is conveyed to the workpiece 2, a voltage of positive polarity being applied to the workpiece 2 and a voltage of negative polarity being fed to the electrolyte. The workpiece 2 is immersed in the bath 1 to below the level of the electrolyte therein. Depending on the shape of the workpieces 2 (FIG. 4) an angle $\beta$ is preset between the cathodes in the form of plates 48, 49 and the vertical axis of the workpiece 2 and a distance is set between the plates 48, 49 and the vertical axis of the workpiece 2. The angle $\beta$ is adjusted by the linkages 50 and rods 51 through actuating the drives 52, whereas the distance is preset by moving horizontally the cover plates 40 and 44.

The ratio between the angle $\beta$ and the distance from the anodes, viz., the workpieces, to the vertical axis of the rake 59 (FIG. 5) makes it possible to control the distribution of current density at the surface of the workpieces 2 along its vertical axis in proportion to the surface of the workpiece 2 being machined. In the course of machining the electrolyte is pumped vertically (in a down-to-top direction) through the group of ejectors 12 (FIG. 4) providing the treatment of the workpiece 2 in an ascending laminar flow. The laminar flow is necessary for stabilizing the plasma-electrolytic process at the surface of the workpiece 2 and preventing separation of the vapor-gas blanket. In order to ensure isothermal conditions of machining and maintain the present level of the electrolyte, an excess of the electrolyte continuously flows over the partition 43.

The mechanism 5 for gripping the workpieces 2 provided with the pivot unit 53 (FIG. 5) operates in the following manner. Initially, the workpiece 2 rests in the position A (FIG. 7). Then the pneumatic cylinder 56 (FIG. 5) of the drive is actuated, and the workpiece 2 executes rotation at a variable speed. The workpiece 2 (FIG. 7) successively assumes positions indicated at A-B-C-B-A. Immersion of the workpiece 2 in the electrolyte horizontally (position A) results in high-quality machining of its lower half accompanied by uniform changing in the surface roughness. The upper part of the workpiece is processed insufficiently with this orientation of the workpiece 2. In order to ensure uniform reduction in surface roughness of the entire workpiece 2, it is necessary to turn the workpiece 2 so that the lower machined part thereof would be orientated upwards. When machining tableware (such as spoons and forks) having a plane of symmetry, reorientation is done by turning them 180°. As the workpiece 2 rests in a position close to the vertical (with the scoop downwards), maximum removal of metal is attained, and therefore for attaining a more uniform reduction in the surface roughness it is necessary to shorten the dwell time of the workpiece 2 is this position. This is attained by rotating the workpiece 2 in the vertical low position at a maximum angular velocity $\omega_{max}$ (FIG. 8). In the position A the workpiece 2 rests an a right angle to the flow of electrolyte. The hatched area shows the portion of the workpiece 2 subject to the most intensive machining. In the position B the lower part of the scoop is treated, whereas in the position C the rest of the workpiece 2 is machined. Variation in the velocity $\omega$ enabling the most uniform machining of the workpiece 2 is characterised by the relationship:

$$\omega = \omega_{max} \sin \alpha,$$

where $\omega_{max}$ is the speed of the workpiece 2 in the position B; and $\alpha$ is the turning angle of the workpiece 2($0° \leqq \alpha \leqq 180°$).

This ensures that the workpiece 2 rests in positions A and C 3 to 5 times longer than in position B. The choice of angular velocity $\omega$ at the point B of 0.075–0.085 rpm is accounted by the following. At a smaller velocity the duration of the polishing process grows resulting in less uniform machining and reducing the efficiency of the process. An increase in the velocity to over 0.085 rpm causes separation of the vapor-gas blanket leading to a sudden reduction in the surface quality due to vigorous etching of the workpiece surface.

The proposed invention can be used with success for machining elongated workpieces of different cross sectional shape (such as rods, wires, saw blades, shaped rolled products), as well as for polishing the surfaces of workpieces of intricate spatial configuration (such as tableware, electric razors, dentures).

We claim:

1. An apparatus for electrochemical machining of workpieces, comprising: a first bath for machining workpieces accommodating electrodes, means for feeding the workpieces to the first bath with mechanisms for gripping the workpieces, and a second bath for cleaning electrolyte communicating with the first bath for machining the workpieces by way of a first pipe for feeding the electrolyte provided with a pump and a second pipe for discharging the electrolyte, the first bath for machining the workpieces having a partition arranged in parallel with a bottom to define therebetween a damping chamber communicating with the first pipe for feeding the electrolyte and provided with a group of wire-gauge ejectors equal in number to a number of workpieces being machined, and a means for maintaining a preset level of electrolyte inside the first bath, comprising a first overflow pipe extending through the bottom of the first bath and the partition and communicating with the second pipe for discharging the electrolyte.

2. An apparatus for electrochemical machining of workpieces as claimed in claim 1, wherein the first bath for machining the workpieces has a group of shields equal in number to at least the number of the workpieces being machined, each of the shields tightly fitting to at least one surface of the workpiece being machined.

3. An apparatus for electrochemical machining of workpieces as claimed in claim 2, wherein each shield has shaped ports.

4. An apparatus for electrochemical machining of workpieces as claimed in claims 1, 2 or 3, wherein walls of the first bath for machining the workpieces have a first set of holes arranged in pairs one in front of another and having a shape corresponding to a shape of the workpieces being machined, each such hole of the first set of holes communicating with a respective discharge passage in turn communicating with the second bath for cleaning the electrolyte.

5. An apparatus for machining of workpieces as claimed in claim 1, further comprising a means for applying to the workpiece a voltage polarity opposite to a polarity of voltage applied to the electrolyte.

6. An apparatus for electrochemical machining of workpieces as claimed in claim 5, wherein the means for applying to the workpieces a voltage polarity opposite to the polarity of voltage applied to the electrolyte comprises two chambers oppositely arranged relative to the first bath for machining the workpieces and communicating by way of pipes with a means for pumping the electrolyte provided inside a vessel, walls of the chambers having a second set of holes for passage of the workpieces being machined, the second set of holes being arranged coaxially with the first set of holes made in the walls of the first bath for machining the workpieces, each chamber having a means for maintaining therein a preset level of electrolyte comprising a second overflow pipe communicating by way of a third pipe with the vessel.

7. An apparatus for electrochemical machining of workpieces, comprising: a first bath for machining workpieces accommodating electrodes means for feeding the workpieces to the first bath with mechanisms for gripping the workpieces, and a second bath for cleaning the electrolyte communicating with the first bath for machining the workpieces by way of a first pipe for feeding electrolyte provided with a pump and a second pipe for discharging the electrolyte, the first bath for machining the workpieces having two vertical partitions of which one partition is positioned with a clearance relative to a bottom of the first bath, a horizontal partition being arranged with a clearance to the bottom of the first bath and connected to inner side walls of the vertical partition to define a damping chamber and provided with a group of wire-gauze ejectors equal in number to a number of means for feeding the workpieces to the first bath extending through a length of the horizontal partition in an area where the workpieces rest, the electrodes being capable of varying an angle of inclination relative to their vertical axis.

8. An apparatus for electrochemical machining of workpieces as claimed in claim 7, wherein, for ensuring that laminar ascending flow of electrolyte uniformly flows around all portions of a surface of the workpiece being machined, each mechanism for gripping the workpiece comprises a rake with a number of teeth corresponding to a number of workpieces being machined, each tooth having a three-point grip with an electrical contact engageable with the surface of the workpiece being machined.

9. An apparatus for electrochemical machining of workpieces as claimed in claim 8, wherein a surface of each electrical contact of the three-point grip engageable with the surface of the workpiece has a form of a prism.

10. An apparatus for electrochemical machining of workpieces as claimed in claim 7, wherein each means for feeding the workpiece to the first bath has a pivot unit.

* * * * *